United States Patent [19]

Szarka et al.

[11] 4,369,840

[45] Jan. 25, 1983

[54] ANCHOR AND ANCHOR POSITIONER ASSEMBLY

[75] Inventors: David D. Szarka; Eugene E. Baker, both of Duncan, Okla.

[73] Assignee: Halliburton Company, Duncan, Okla.

[21] Appl. No.: 107,753

[22] Filed: Dec. 27, 1979

[51] Int. Cl.[3] ..... E21B 23/00

[52] U.S. Cl. ..... 166/214; 166/51; 166/216; 166/240; 166/381; 166/386

[58] Field of Search ..... 166/315, 214–217, 166/138–139, 136, 206, 240, 381, 386

[56] References Cited

U.S. PATENT DOCUMENTS

| | | | |
|---|---|---|---|
| 2,431,751 | 12/1947 | Hayward | 166/217 |
| 2,673,614 | 3/1954 | Miller . | |
| 2,988,177 | 6/1961 | Conrad | 188/83 |
| 2,989,122 | 6/1961 | Kenneday | 166/216 |
| 2,991,835 | 7/1961 | Schwab | 166/214 |
| 3,057,407 | 10/1962 | Grimmer | 166/125 |
| 3,209,832 | 10/1965 | Tausch | 166/240 |
| 3,297,083 | 1/1967 | Taylor | 166/214 |
| 3,412,790 | 11/1968 | Brown | 166/240 |
| 3,430,699 | 3/1969 | De Cuit | 166/217 |
| 3,455,381 | 7/1969 | Page, Jr. . | |
| 3,507,329 | 4/1970 | Stone, Jr. . | |
| 3,519,074 | 7/1970 | Berryman . | |
| 3,603,392 | 9/1971 | McGill | 166/240 |
| 3,698,477 | 10/1972 | Radig et al. | 166/214 |
| 3,746,093 | 7/1973 | Mullins | 166/217 |
| 3,783,941 | 1/1974 | Kisling | 166/138 |
| 3,937,279 | 2/1976 | Raulins | 166/214 |
| 4,059,150 | 11/1977 | Manderscheid | 166/120 |
| 4,105,069 | 8/1978 | Baker | 166/51 |
| 4,139,059 | 2/1979 | Carmichael | 166/208 |

FOREIGN PATENT DOCUMENTS

| | | |
|---|---|---|
| 924644 | 4/1963 | United Kingdom . |
| 938512 | 10/1963 | United Kingdom . |
| 980655 | 1/1965 | United Kingdom . |
| 998207 | 7/1965 | United Kingdom . |
| 1194102 | 6/1970 | United Kingdom . |
| 1218448 | 1/1971 | United Kingdom . |
| 1482125 | 8/1977 | United Kingdom . |
| 1491378 | 11/1977 | United Kingdom . |
| 1515248 | 6/1978 | United Kingdom . |
| 1523674 | 9/1978 | United Kingdom . |
| 1539800 | 2/1979 | United Kingdom . |
| 1561847 | 3/1980 | United Kingdom . |
| 2039310 | 6/1980 | United Kingdom . |

*Primary Examiner*—Stephen J. Novosad
*Attorney, Agent, or Firm*—Joseph A. Walkowski; Thomas R. Weaver

[57] ABSTRACT

An anchor tool and cooperating anchor positioner for use in a well bore are disclosed. The anchor tool may be employed as part of a well casing or liner, while the anchor positioner is part of a tool string run inside the casing or liner. The anchor positioner locates and anchors the tool string at a desired level in the well bore by engagement with the anchor tool placed at that location. Multiple anchor tools may be employed if it is desired to deploy the tool string at different levels. All operation of the anchor positioner is effected by mechanical force.

20 Claims, 28 Drawing Figures

ANCHOR AND ANCHOR POSITIONER ASSEMBLY

SUMMARY OF THE INVENTION

When drilling, treating and producing petroleum and natural gas wells, it often is desirable and sometimes necessary to locate and anchor various tools or other devices suspended from a string of pipe at a particular level in the well bore. Such an operation is necessary in oil wells, for example and not by way of limitation, when gravel packing a producing formation, when chemically treating a formation, when cementing a well, when inflating a packer or when testing a well. A number of different devices designed to accomplish this operation have been employed in the prior art, utilizing different approaches.

U.S. Pat. No. 2,673,614 discloses an apparatus for anchoring tools within a well, which apparatus employs keys to locate the anchor at the appropriate levels in the well, and locking dogs to hold it. However, the grooves in the well casing which the keys engage at various levels are all different, the anchor may engage at only one level per trip in the well, and the anchor may be retrieved only by pulling the pipe string, attaching a fishing tool, and going back in the well to engage the anchor. U.S. Pat. Nos. 3,057,407 and 3,507,329 disclose similar devices which are somewhat improved in operation, but which still possess the same enumerated disadvantages.

U.S. Pat. Nos. 3,455,381, 3,519,074, 3,603,392, 3,783,941 and 4,059,150 disclose setting or anchoring tools employing the use of mechanically or hydraulically operated slips to position and anchor the tool string in the well. The employment of slips, however, does not permit precise positioning, and, moreover, may lead to the tool string becoming stuck in the well if the slips fail to release.

U.S. Pat. Nos. 3,937,279 and 4,139,059 disclose devices which employ collet fingers to hang the tool string at a particular level when the fingers engage a shoulder in the well casing. While providing a positive means of location in the well, neither possesses a means to lock the positioning fingers in a retracted position so as to pass by a shoulder in the casing, or to visit more than one level per trip into the well.

U.S. Pat. No. 4,105,069 discloses a retraction mechanism similar to that of the present invention, but for use in operating a cementing or gravel collar. Positioning the tool string disclosed therein is accomplished by logging the positions of the collars, and hanging the tool string on collar sleeves at the various levels with permanently released spring arms necessitating a balancing of weight on the tool string to ensure the collar is not reclosed. No separate anchor tool is employed, so the collars cannot remain open as the tool string passes downward, and the spring fingers must be forced through the collars at each level.

Generally, the prior art suffers from a number of deficiencies, and the employment of a particular type of mechanism to overcome one problem results in the insolubility of another. The first difficulty encountered is an inability to locate the exact position desired in the well bore, which is inherent to the use of slips. When that problem is solved through the use of keys or collet fingers, the prior art encounters the inability to visit more than one level per trip in the well. Indeed, many prior art tools require two trips per location, one to set the anchor and another to retrieve it. If an operator employs a prior art tool which can visit multiple locations, even with multiple trips, he is faced with the problem of putting various nipples or landing shoulders of different sizes and configurations in the liner or casing string, which necessarily complicates both the installation and inventory of parts which must be utilized. Finally, even those devices which permit the visitation of multiple levels per trip are dependent on the application of a relatively large force to release, and may interfere with the operation of other tools in the liner.

In contrast, the present invention overcomes all of the previously enumerated disadvantages and limitations of the prior art by providing a new and advantageous method and apparatus for locating a tool string at a specific level in a well bore, anchoring the string at that level and proceeding from that level to another in the well bore, either higher or lower, in the same trip. The present invention contemplates a two-part anchoring apparatus, comprising an anchor tool incorporated in a liner or casing, and a cooperating inner anchor positioner which is attached to a tool string. The anchor tool possesses substantially the same inner bore as that of the casing above and below it, with an annular upward-facing shoulder upon its inner wall, there being areas of enlarged diameter both above and below the shoulder. The anchor positioner comprises upward-projecting spring arms having at their extremities radially outward projecting, downward-facing shoulders. When these shoulders engage the annular shoulder of an anchor tool, the anchor positioner is locked in position. In order to release the anchor positioner, a drag block assembly which can be made to engage and compress the spring arms is slidably mounted above the spring arms, thereby releasing them from the anchor tool, by either reciprocating or rotary and reciprocating motion of the tool string, as illustrated in another embodiment of the invention. Yet another embodiment of the invention is also disclosed which employs both rotary and reciprocating motion to lock and unlock the anchor positioner from the anchor tool, and utilizes splines on the anchor positioner which cooperate with grooves on the anchor tool to lock the anchor positioner in place. All of these embodiments possess the capability of visiting multiple locations with a tool string in one trip in the well, locking the tool string at each location, and subsequently releasing and repositioning the tool string at another level higher or lower than the first. The anchors for an individual embodiment are the same at each level, and no additional mechanisms other than the anchor and anchor positioner are necessary for operation of the device.

It is thus apparent that the apparatus and method of the present invention possesses many new advantages hitherto unknown in the prior art, without any disadvantages being associated therewith.

BRIEF DESCRIPTION OF THE DRAWINGS

FIGS. 18A, 18B, 18C and 18 illustrate in simplified vertical cross-sectional elevation the utilization of the preferred embodiment of the present invention with a gravel-packing tool string.

FIG. 19 illustrates the preferred embodiment shown in FIG. 18 in the retract mode.

DESCRIPTION OF THE PREFERRED EMBODIMENT

Figure 1A:
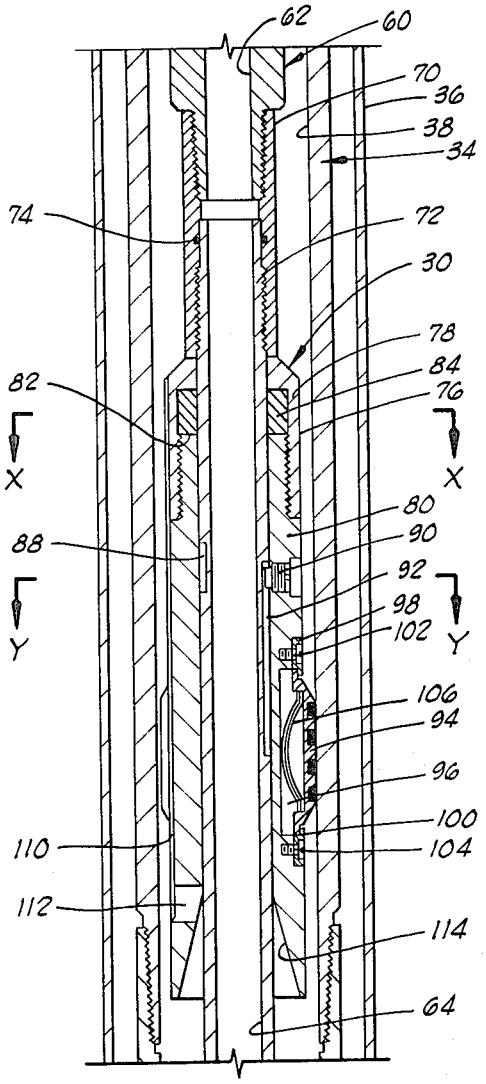
FIGS. 1A and 1B provide a vertical cross-sectional elevation illustrating the anchor positioner and anchor tool of the present invention, the anchor positioner being in its release mode, anchored in the anchor tool.
Figure 1B:
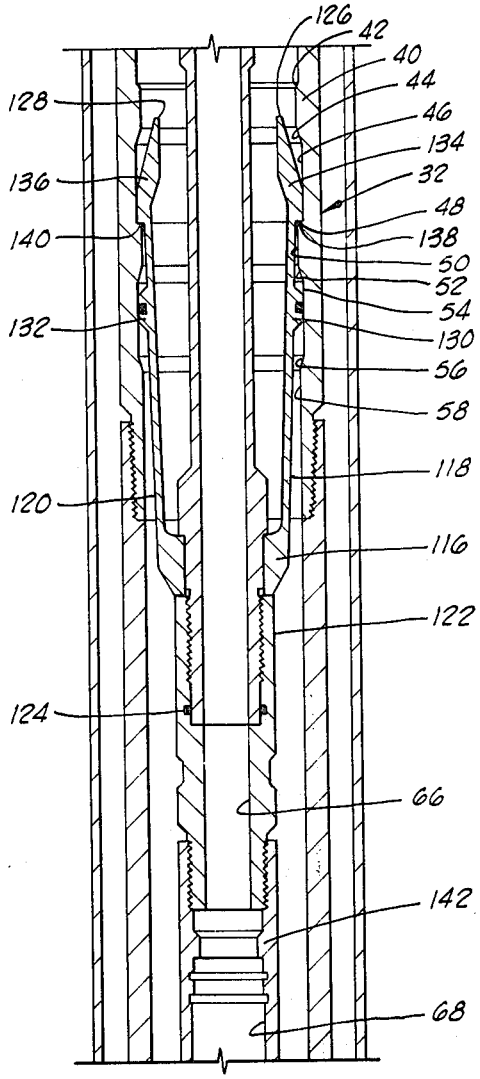
Figure 2:
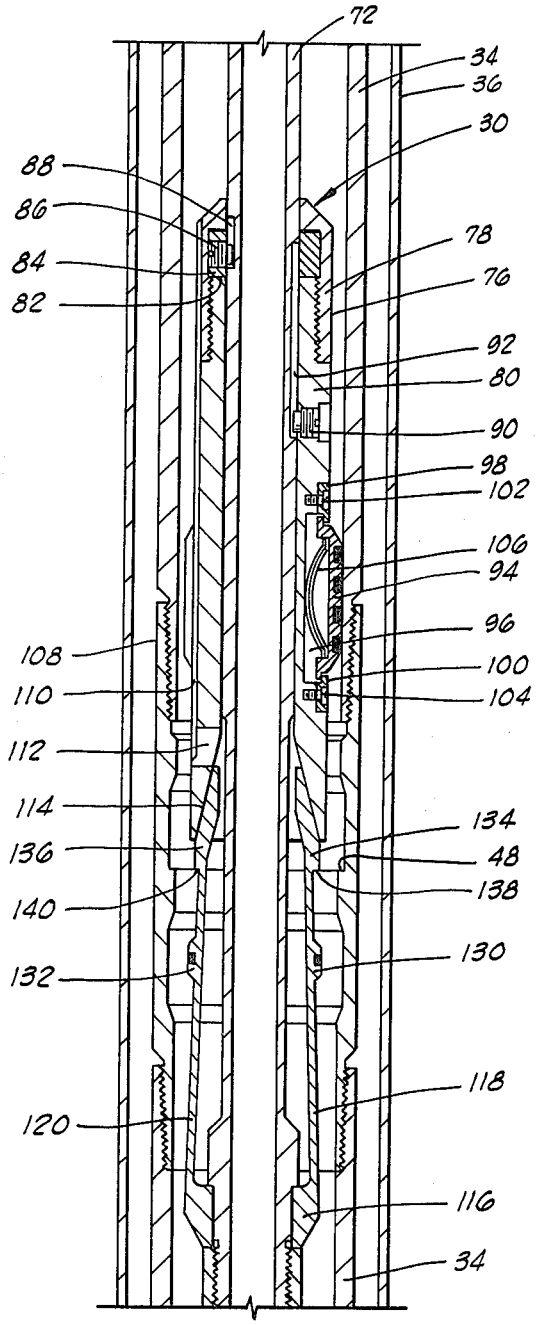
FIG. 2 provides a vertical cross-sectional elevation illustrating the anchor positioner in its retract mode after release from the anchor tool.

Referring now to the drawings, and to FIGS. 1A, 1B and 2 in particular, the anchor positioner and anchor tool of the present invention are illustrated in detail. Anchor positioner 30 is disposed within a liner 34 at a location where anchor tool 32 is positioned. Liner 34 is in turn disposed within casing 36, in a well bore (not shown). Moving downwardly from the top of the liner as shown, bore 38 continues to anchor tool 32, where uniform inward-facing annular surface 40, defined by an upper beveled surface 42 as well as a lower, extended beveled surface 44 leading to annular recess 46 is located. At the lowest extremity of recess 46 is located inwardly extending upward-facing annular shoulder 48, below which is axial surface 50, and outwardly beveled surface 52, followed by a second annular recess 54. Both surfaces 46 and 54 possess a bore larger than that of liner 34. Below recess 54 inwardly beveled surface 56 leads to lower bore 58, of substantially the same diameter as liner bore 38. It should be noted that anchor tool 32 has been located in the well bore so that a tool string 60 to which is attached anchor positioner 30 will be properly positioned to effect treatment of a well such as acidizing, cementing or gravel packing via other tools on tool string 60 in cooperation with tools in liner 56. For example, the operator may want to position an isolation gravel packer across a gravel collar, as will be discussed hereafter with reference to FIGS. 18A through D and FIG. 19. Similarly, a cementing collar may be located. In addition, it is understood that the anchor tool of the present invention is not limited to employment as part of a liner, but may be utilized as part of a casing in an unlined hole in the same manner as illustrated herein with respect to a liner.

Figure 5:
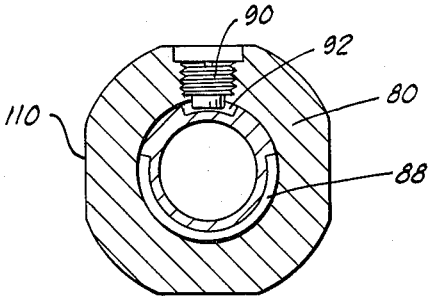
FIG. 5 is a horizontal cross-sectional elevation of the anchor positioner taken across line y—y of FIG. 1A.
Figure 6A:
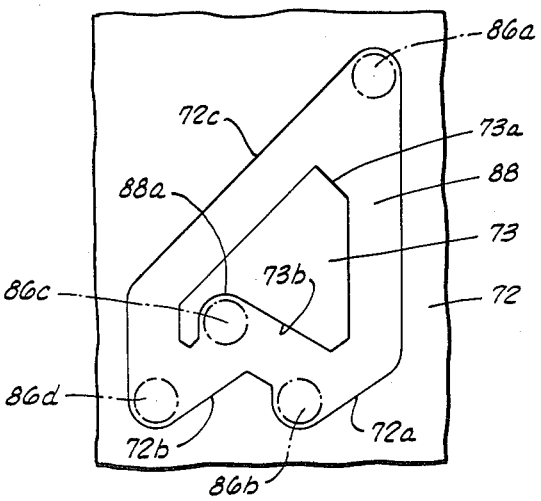
FIGS. 6A and 6B are developments of the J-slots employed in the present invention.
Figure 6B:
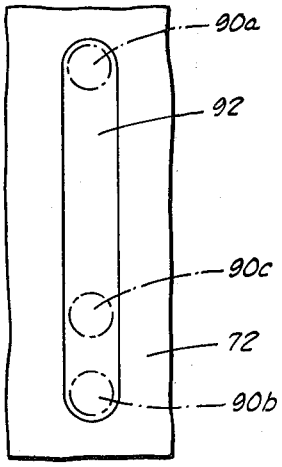
Figure 7A:
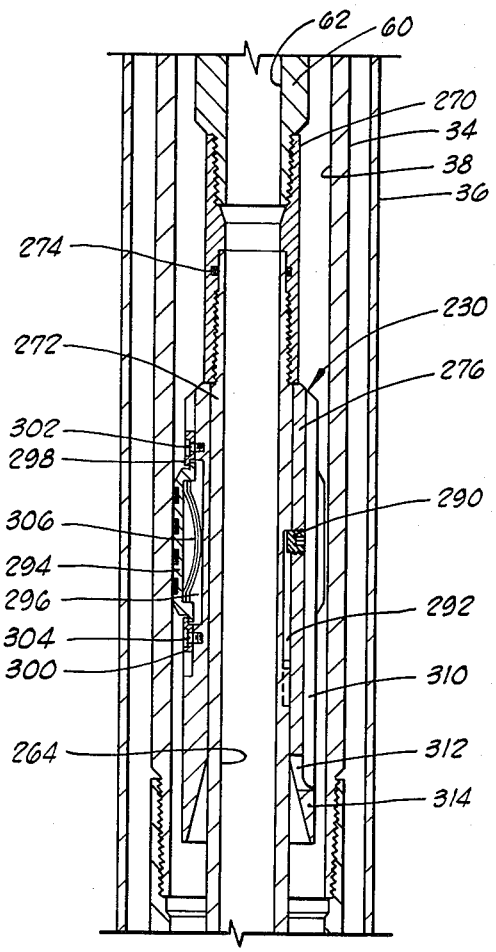
FIGS. 7A and 7B provide a vertical cross-sectional elevation illustrating an alternative embodiment of the anchor positioner employed with the anchor tool of the present invention, the anchor positioner being in its release mode, anchored in the anchor tool.
Figure 7B:
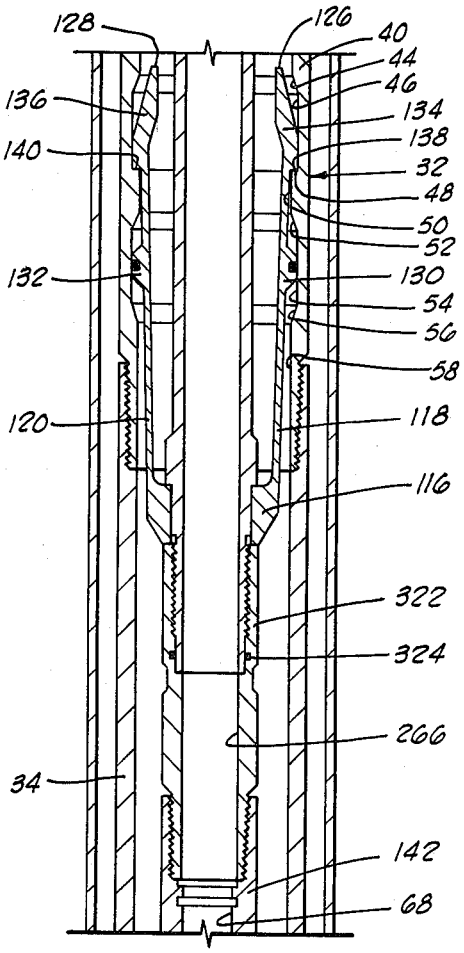

Referring again to FIGS. 1A and 1B of the drawings, anchor positioner 30 is lowered into liner 34 with tool string 60. If desired, tool string 60 may have bore 62 therethrough, cooperating with bores 64, 66 and 68 whereby fluids may be transmitted up or down the interior of the tool string. Anchor positioner 30 is threadably attached to adapter 70, which is in turn threadably attached to mandrel 72 and a fluid seal provided therebetween by O-ring 74 disposed in an annular recess in adapter 70. Slidably mounted on mandrel 72 is drag block assembly 76, comprising housing sleeve 78 and drag block body 80, which are threadably engaged. Within recess 82, defined by housing sleeve 78, drag block body 80 and mandrel 72, is disposed ring 84 having fixed thereto one end of pin 86 (see FIG. 2). Ring 84 is not fixed within recess 82, but may rotate therein, and is of a greater inside diameter than mandrel 72 so as to be axially movable thereon. The free end of pin 86 slidably engages complex slot 88, a development of which is illustrated in FIG. 6A, in the surface of mandrel 72. The rotational freedom of ring 84 in recess 82 combined with the axial freedom of movement of drag block assembly 76 permits pin 86 to follow the edges of complex slot 88, as will be explained in greater detail hereafter. Fixed to drag block body 80 is pin 90, which slidably engages straight slot 92, a development of which is illustrated in FIG. 6B, in the surface of mandrel 72. Slots 88 and 92 are circumferentially spaced around the surface of mandrel 72, as shown in FIG. 5, a section across line y—y of FIG. 1A. A plurality of drag blocks, (four being employed in the preferred embodiment by way of illustration and not limitation) indicated in section at 94 are disposed in circumferentially spaced axial slots 96 formed in drag block body 80. As shown, a drag block may have carbide buttons (unnumbered) on its surface, to enhance wear characteristics. Each drag block 94 is retained within its slot 96 by a pair of brackets 98 and 100, each secured to drag block body 80 by bolts 102 and 104, respectively. Each drag block 94 is biased outwardly within its slot 96 by spring 106. The left hand side of FIG. 1A shows drag block assembly 76 rotated 45°, thereby illustrating axial flat 110 which may be interposed between each drag block, as well as radial port 112 which communicates with each axial flat 110 and frusto-conical surface 114 at the lowest extremity of drag block assembly 76.

Disposed below drag block assembly 76 is spring arm collar 116 upon which are disposed a plurality of spring arms 118 and 120, as well as two others on a perpendicular plane, not shown. Spring arm collar is fixed to mandrel 72 by the threaded engagement of lower body 122 to mandrel 72, a fluid seal being effected therebetween by O-ring 124. Between spring arm collar 116 and tips 126 and 128 of spring arms 118 and 120, respectively, are located radially outwardly extending shoulders 130 and 132, each shoulder having a flat outer surface bounded by upper and lower beveled edges. Carbide buttons (unnumbered) may be embedded in each shoulder. Moving toward the upper end of spring arms 118 and 120, protrusions 134 and 136 comprise radial or perpendicular downward-facing shoulders 138 and 140 above which are axial flats and inwardly inclined outer edges extending to tips 126 and 128. The tips 126 and 128 are disposed on a radius less than that of the largest diameter of frusto-conical surface 114.

Below lower body 122 is attached the remainder of the tool string, designated by the numeral 142.

OPERATION OF THE PREFERRED EMBODIMENT

Referring to FIGS. 1A, 1B, 2, 3, 4, 5, 6A and 6B, the operation of the preferred embodiment of the present invention will be described in detail.

Anchor positioner 30 has two positions, preferably referred to as "modes" of operation. FIGS. 1A and 1B illustrate the release mode, wherein outwardly biased spring arms 118 and 120 are unconstrained by drag block assembly 76. FIG. 2 illustrates the retract mode, wherein spring arms 118 and 120 are inwardly constrained by the frusto-conical surface 114 of drag block assembly 76. Anchor positioner 30 is changed from one mode to the other by reciprocation of tool spring 60, which effects the axial sliding of drag block assembly 76 upon mandrel 72 through the sliding engagement of pins 86 and 90 in slots 88 and 92, respectively. As noted previously, slots 88 and 92 are circumferentially spaced around mandrel 72, the slot 92 having only an axial component and slot 88 having both axial and circumferential components, as shown in developments of the two slots, FIGS. 6A and 6B. As noted in FIG. 6A, the edges of slot 88 are defined by both mandrel 72 and cam island 73.

Pin 90 is fixed at one end to drag block body 80, with its one end being constrained in all but an axial direction in slot 92, with the result that drag block body 80 and drag block assembly 76 are also prevented from rotating about mandrel 72. This is not to imply that the constraint against rotation must utilize a pin and slot interaction as shown, as mandrel 72 could be made of irregular cross-section for an axial distance equal to the travel of drag block assembly 76, which would then be machined to a corresponding cross-section on the interior thereof for a like distance. Similarly, a pin could be fixed to mandrel 72 and the slot machined in the inner surface of drag block body 80. These and other equivalents would, of course, be obvious to one of ordinary skill in the art.

Figure 3:
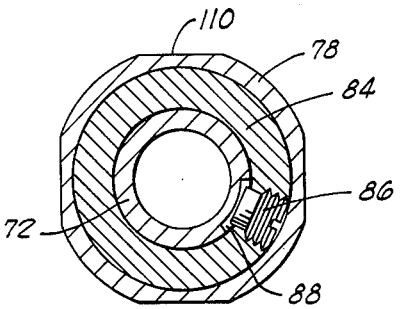
FIG. 3 is a horizontal cross-sectional elevation of the anchor positioner taken across line x—x of FIG. 1A.
Figure 4:
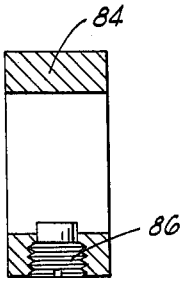
FIG. 4 is a cross-section of the pin and ring assembly of the internal rotating J-slot mechanism of the present invention.

Drag block assembly 76 being prevented from rotating, axial movement of tool spring 60 and hence of mandrel 72 acts upon pin 86 through complex slot 88 to effect the previously-noted tool modes. When pin 86 encounters a non-axially oriented slot edge, lateral or circumferential motion of pin 86 in response to the force of the edge acting thereon is permitted by the rotation of ring 84 in recess 88. Axial movement of pin 86 is effected by movement of the entire drag block assembly 76, as with pin 90 in slot 92, since ring 84 slides along mandrel 72 with the rest of the drag block assembly 76 in which it is housed. FIG. 3, taken along line x—x of FIG. 1A, illustrates the manner in which ring 84 is housed between mandrel 72 and housing sleeve 78. For further clarification, FIG. 4 illustrates a section of the assembly of pin 86 and ring 84. The description of the pin, ring and slot interaction does not imply that a different configuration could be employed, for example, cutting an annular recess in mandrel 72, directing the pin 86 outwardly into engagement with an axially reversed slot cut in the interior of drag block assembly 76.

Referring to FIGS. 1A, 1B, 2, 6A and 6B specifically, pin 86 is at position **86*a* in slot 88 (FIG. 6A) when anchor positioner 30 is in its release mode (FIGS. 1A and 1B), drag block assembly 76 being axially spaced from spring arms 118 and 120, drag block assembly 76 being held away from spring arms 118 and 120 by the frictional engagement of drag blocks 94 with the inner wall of liner 34. At the same time, pin 90 is at position 90*a* in slot 92. Upon upward axial movement of tool spring 60 and hence mandrel 72, pin 86 is directed relatively downwardly in slot 88 to position 86*b* by mandrel edge, being initially directed away from position 86*d* by cam island edge 73*a*. Pin 90 moves to position 90*b*. During the downward travel of pin 86, drag block assembly 76 also moves toward spring arms 118 and 120, whereupon frusto-conical surface 114 engages the inclined outer edges of protrusions 134 and 136 and cams them inwardly, away from annular shoulder 48 of anchor tool 32, thus effecting the retract mode of anchor positioner 30 (FIG. 2). It should be noted again that the lowermost edge of frusto-conical surface 114 is disposed on a radius greater than that of the tips 126 and 128 of spring arms 118 and 120 because of a radially inward bias due to their engagement with anchor tool 32, so as to encompass edges 126 and 128 when in contact therewith. When anchor positioner 30 is not engaged with an anchor tool, the inwardly biasing effect of the beveled shoulders 130 and 132 on spring arms 118 and 120 maintains the spring arm tips 126 and 128 on a radius less than the lowermost edge of frusto-conical surface 114 so that the anchor positioner may be placed in its retract mode at any time. As tool string 60 is subsequently moved downward, anchor positioner 30 is locked in its retract mode, pin 86 being directed to position 86*c* in slot recess 88*a* by cam island edge 73*b*. Pin 90 follows axial movement of drag block assembly 76 to position 90*c*. The release spring arms 118 and 120, upward movement of tool spring 60 and mandrel 72 brings pin 86 to position 86*d* through the guidance of mandrel edge 72*b*, pin 90 moving back to position 90*b* (by virtue of there only being an axial component to its movement), and subsequent downward movement of tool string 60 brings pin 86 back to position 86*a*, frusto-conical surface 114 of drag block body 76 thus releasing spring arms 118 and 120. Pin 86 is directed back to position 86*a* by mandrel edge 72*c*, and pin 90 in slot 92 parallels the axial component of the movement of pin 86, returning to position 90*a***.

Assuming tool string 60 is to be positioned at several levels in a well bore, anchor positioner 30 is lowered on tool string 60 to the approximate location of the first level to be visited. If this is the uppermost level, it does not matter whether anchor positioner 30 is in the release or retract mode, as it will travel down the liner until encountering the shoulder of the first anchor tool, for example shoulder 48 of anchor tool 32. Spring arms 118 and 120 are biased away from engagement with any irregularities on the bore 38 of liner 34 by beveled shoulders 130 and 132. When spring arms 118 and 120 encounter an anchor tool, there is no inward biasing action as the recesses on either side of anchor tool shoulder 48 have inside diameter greater than that of the liner, thereby permitting the beveled shoulders and thus the spring arms greater radial extension, causing engagement of the spring arms with the anchor tool. If, however, the first level desired to be visited is not the uppermost, anchor positioner 30 should be in the retract mode. If it is not, upon contact of spring arms 118 and 120 with shoulder 48, upward and subsequent downward reciprocation of the tool string 60 will retract anchor positioner 30, allowing it to pass to lower levels. It may be noted at this point that axial flats 110 in conjunction with radial ports 112 facilitate fluid movement past drag block assembly 76, easing movement in the well bore. At the approximate location of the desired lower level, upward and subsequent downward reciprocation of tool string 60 will again release anchor positioner 30, which is then lowered into engagement with the shoulders of the appropriate anchor tool. Should the anchor positioner pass through the appropriate anchor tool while being still retracted, it need only be raised above the anchor tool, and subsequently lowered into locking engagement with the anchor tool shoulder.

After the tool string 60 is locked into position, any desired operations such as gravel packing, cementing, acidizing, etc. may be performed through tools on tool string 60 in cooperation with those positioned at that level of liner 34. After completion of the operations at that level, tool string 60 is picked up again to retract anchor positioner 30, and then raised or lowered to the next desired level. It should be noted at this point, due to the configuration of spring arms 118 and 120, that if drag block assembly 76 should jam with the anchor positioner 30 in the release mode, however unlikely, the inclined outer edges on protrusions 134 and 136 would be cammed inwardly upon encountering any obstacles, this camming effect being augmented by shoulders 130 and 132, so that tool string 60 could be withdrawn to the surface without difficulty.

For purposes of illustration only, and not by way of limitation, the use of anchor positioner 30 as part of a gravel packing tool string will be discussed, referring specifically to FIGS. 18A through D and FIG. 19.

The tool string is generally designated by the reference character 60, and is disposed in a liner concentrically surrounding it as designated by the reference character 34. Disposed about the two concentric strings is well casing 36, having perforations therethrough at the levels of two unconsolidated producing formations through which the well bore passes.

Liner 34 is secured within well casing 36 by means of a suitable liner hanger 600 with casing packer 604, as illustrated schematically. Liner hanger 600 is positioned in casing 36 by means of slips 602 employed in mechanically setting packer 604. Threaded collar 606 is employed to secure liner 34 to a drill string during its installation in the well bore inside the wall casing 36.

Moving downwardly from liner hanger 600, the liner comprises a length of blank pipe (not shown) to a location just above the highest zone to be packed. At that point is located a casing inflation packer, illustrated schematically at 610. Annular space 612 defined by mandrel 614 and elastomeric outer wall 616 is inflated by pumping fluid through schematically illustrated check valve 618 to a predetermined pressure.

Below packer 610 is located gravel collar 620. Gravel collar 620 comprises body 622 within which is slidably disposed sleeve 624. Inside case 622 sleeve 624 has disposed thereabout four annular seals (unnumbered). At the top of sleeve 624 is located downward-facing annular shoulder 630. Between the upper and lower pair of annular seals apertures 632 and 634 communicate with gravel ports 626 and 628 when aligned therewith. At the lowest extremity of sleeve 624 are located a ring of collect fingers 636 having radially outward extending lower ends. Polished nipple 640 is disposed below gravel collar 620.

Anchor tool 32 (in simplified form) is located below polished nipple 640. At the top of anchor tool 32 an inwardly beveled annular surface 44 leads to annular recess 46, below which is upward-facing annular shoulder 48, below which an outwardly beveled surface leads to annular recess 54, followed by an inwardly beveled surface leading to cylindrical surface 58, which is of substantially the same inner diameter as blank pipe 650, immediately below.

Gravel screen 600 is disposed across the upper producing formation or zone of interest below blank pipe 650.

Referring to the lower zone of interest, casing inflation packer 670, substantially identical to packer 610, is located below gravel screen 660 to isolate the upper zone of interest from the lower zone. Space 672 defined by mandrel 674 and elastomeric outer wall 676 is inflated by pumping fluid through schematically illustrated check valve 678 to a predetermined pressure.

Below packer 670 is located a second gravel collar 680, substantially identical to gravel collar 620. Gravel collar 680 comprises outer body 682 within which is slidably disposed sleeve 684. Gravel ports 686 and 688 extend through body 682. Sleeve 684 possesses four annular seals (unnumbered) and at the top of sleeve 684 lies downward facing shoulder 690. Between the upper and lower pair of annular seals, apertures 692 and 694 communicate with gravel ports 686 and 688 when aligned therewith. At the lowest extremity of sleeve 684 are located a ring of collect fingers having radially outward extending lower ends. Below gravel collar 680 is disposed polished nipple 700.

Second anchor tool 32' (again in simplified form) is located below polished nipple 700. At the top of anchor tool 32' an inwardly beveled surface leads to annular recess 46', below which is upward-facing annular shoulder 48', below which an outwardly beveled surface leads to annular recess 54' followed by an inwardly beveled surface leading to cylindrical surface 58', which is of substantially the same inner diameter as blank pipe 710, below.

Gravel screen 720 is disposed across the lower producing formation or zone or interest. Gravel screens 660 and 720 are fore-shortened in the drawings herein, and actually may be a number of feet in length, the length being determined by the thickness of the producing formation to be gravel packed, all of which is evident to those skilled in the art, it being further evident that the gravel screens may have perforations, as shown, or may employ wire-wrapped slots to form the desired perforations.

Another length of blank pipe 730 is attached below gravel screen 720, and the lowest end of the pipe is capped with a float shoe 740.

It may be noted that the proper orientation of tool string 60 with respect to liner 34 at each zone is dependent upon the polished nipples 640 and 700 being of the appropriate length to position isolation gravel packer 760 (see FIG. 18C) across either gravel collar 620 or 680 when the tool string anchor positioner 30 is anchored in anchor tool 32 or 32', respectively.

Inner blank pipe 750 and concentric outer blank pipe 752 extend downward to isolation gravel packer 760 from the surface. Concentric pipes 750 and 752 must obviously be of sufficient length to permit positioning of the isolation gravel packer 760 (FIG. 1C) across the lowest gravel collar 680. As the two lengths of pipe cannot be matched exactly, it is of course necessary to include a slip joint and swivel assembly illustrated in simplified form at 754 in the inner string of pipe; inner element 756 slides vertically and rotationally within outer element 758, the two having an annular fluid seal therebetween (not shown).

Referring to FIG. 18C, blank pipes 750 and 752 enter the top of isolation gravel packer 760. At the top end of isolation gravel packer 760 blank pipe 750 communicates with axial circulation passage 762 and the annulus 751 between pipes 750 and 752 communicates with outer passages 764 and 766.

Disposed about the exterior of the isolation gravel packer are downward-facing packer cups 768 and 770. Below packer cups 768 and 770, lateral gravel passages 772 and 774 communicate with inner annular passage 776 and are aligned with gravel ports 686 and 688 when the isolation gravel packer 760 is anchored in place at the lower zone adjacent gravel collar 680 by engagement of anchor positioner 30 with anchor tool 32'.

At the lowermost end of isolation gravel packer 760 are mounted upward-facing packer cups 778, 780 and 782, and downward-facing packer cup 784. Between packer cups 780 and 782 are located lateral circulation passages 786 and 788, which communicate with axial circulation passage 762.

Immediately below isolation gravel packer 760 is ball check valve 800. Bypasses 802 permit fluid flow upward into axial circulation passage 762, from tail pipe 830 but seat 804 halts downward flow when circulation is reversed and ball 806 is forced against it.

At approximately the same location as ball check valve 800 is opening sleeve positioner 810, comprising a sleeve positioner body and spring arms 812 and 814, each having a radially outwardly extending shoulder with beveled edges thereon. At the ends of the spring arms 812 and 814 are located protrusions having an upward-facing radially outward extending shoulder at the top thereof, the lower outside face of each protrusion being beveled inwardly in a downward direction. Spring arms 812 and 814 are shown in a slightly compressed position against the interior of liner 34 at polished nipple 700.

Below opening sleeve positioner 810 in tool string 60 is located anchor positioner 30, shown in simplified form. Anchor positioner 30 comprises drag block assembly 76 and spring arm collar 116. Drag block assembly 76 is slidably mounted on mandrel 72, in which are located slots 88 and 92, shown schematically. Pin 90 is fixed to drag block assembly 76, and slides within slot 92. Pin 86 is mounted in ring 84 which encircles mandrel 72 and is housed in annular recess 82 in drag block assembly 76. On drag block assembly 76 are spring-loaded drag blocks 94 shown schematically, which press against the inside of liner 34, thus centering the anchor positoner 30 and frictionally maintaining drag block assembly 76 in place with respect to mandrel 72. The lower face 114 of drag block assembly is frustoconical in configuration, being inclined inwardly and upwardly from the lowest extremity thereof. Below drag block body 76, spring arm collar 116 possesses upward-facing spring arms 118 and 120. Spring arms 118 and 120 possess radially outward extending shoulders 130 and 132, as well as protrusions 134 and 136 at their upper ends. Spring arms 118 and 120 are shown engaged with shoulder 48' of anchor tool 32' in FIG. 18D.

Below anchor positioner 30 is located closing sleeve positioner 820, comprising a positioner body on which are mounted downward-facing spring arms 822 and 824. Each spring arm possesses outward radially extending shoulders the edges of which are beveled, and at the lowest end of the spring arms there are located protrusions having upward-facing outwardly radially extending shoulders at their upper edges, and downward inwardly beveled edges on their lowermost exteriors. Spring arms 822 and 824 are shown in slightly compressed positions against the interior of liner 34 at blank end pipe 730.

At the lowest extremity of operating string 30 is tail pipe 830, having bore 832 which, in conjunction with bores through closing sleeve positioner 820, anchor positioner 30 and opening sleeve positioner 810, communicates with check valve 800.

After the well is drilled and casing 36 inserted it is perforated at the appropriate intervals adjacent the producing formations, washed and possibly treated in some manner. At this point, liner 34 is lowered into the well bore and hung within casing 36 by liner hanger 600.

The liner 34 as installed in the casing, comprises as many gravel collars as there are zones to be packed, as shown in the present instance by reference characters 620 and 680. As noted previously, the gravel collars 620 and 680 are located above their respective zones to be packed, while corresponding gravel screens 660 and 720 are located adjacent to and spanning these zones. Between each gravel collar and its corresponding gravel screen are located polished nipples 640 and 700, and anchor tools 32 and 32', respectively, which accurately position the tool string 60 at each zone when the anchor positioner 30 is engaged in the appropriate anchor tool.

Above the upper zone is located suitable casing inflation packer 610, and below the zone is suitable casing inflation packer 670, which, when inflated isolate the upper zone from the zone below and the well annulus above.

After the liner 34 is hung in the casing, the tool string 60 is run into the well bore. The operator has the option of inflating casing inflation packers 610 and 670 as the tool string 60 is going down the well bore, or he may elect to inflate the packers from the bottom as he proceeds upward. He may, in fact, inflate the packers in any order but for purposes of discussion the methods of inflating packers from the top down will be more fully described hereinafter.

With anchor positioner 30 in its retract mode, tool string 60 is lowered to the approximate location of the lower zone anchor tool 32'. The tool string 60 is then reciprocated upward to effect the release mode, and anchor positioner 30 is then lowered to engage anchor tool 32'. If the anchor positioner happens to be released below anchor tool 32', it may be raised through it even in the release mode, as the inclined outer edges of protrusions 134 and 136 will guide spring arms 118 and 120 past shoulder 48' of anchor tool 32'. Anchor positioner 30 is locked in position when downward-facing shoulders on protrusions 134 and 136 are resting on shoulder 48'. At this point, unlike FIG. 1C, gravel collar 680 will be closed (as gravel collar 620 in FIG. 18B), as no steps have yet been taken to open it. Inflation port 678 of casing inflation packer 670 is spanned by downward-facing packer cups 768 and 770 and upward-facing packer cups 778 and 780 of isolation gravel packer 760. Tool string 60 is then pressured to the desired pressure through blank pipe annulus 751 to inflate casing inflation packer 670. The pressurized fluid reaches packer 670 through outer passages 764 and 766, inner annular passage 776, then gravel passages 772 and 774 which exit into the packer annulus, defined by the interior of liner 34, the exterior of isolation gravel packer 760, packer cups 768 and 770 at the top, and 778 and 780 at the bottom. From the packer annulus, fluid enters casing inflation packer 670 through check valve 678, inflating it to a predetermined pressure. The casing inflation packer being inflated, gravel packing may now proceed at the lowest zone as described hereafter.

Gravel collar 680 is opened by reciprocating tool string 60 to retract the anchor positioner 30, and raising the tool string 60 so that opening sleeve positioner 810 engages sleeve 684 of full open gravel collar 680 as shown in FIG. 19. Spring arms 812 and 814 of opening positioner 810 expand, engaging annular shoulder 690 on sleeve 144. An appropriate upward pull will align apertures 692 and 694 of sleeve 684 with gravel ports 686 and 688 of body 682, thereby opening the gravel collar 680. As the open position of gravel collar 680 is reached, the radially outward extending shoulders on spring arms 812 and 814 have contacted the beveled edge leading to the necked-down area above the sleeve, which contact compresses spring arms 812 and 814, causing them to release from sleeve 684, leaving gravel collar 680 in the open position. The tool string 60 is then lowered to the approximate location of the anchor 32', then picked up again to release the anchor positioner 30, and lowered until the anchor positioner 30 is locked in anchor 32'. At this point, gravel packing may begin.

A slurry of carrier fluid containing gravel is pumped down blank pipe annulus 751 into passages 764 and 766, inner annular passage 776 and out through gravel passages 772 and 774 into the packer annulus, then through gravel ports 686 and 688 of gravel collar 680 into the lower zone annulus, where the gravel is deposited. The carrier fluid returns into liner 34 through gravel screen 720, the gravel being retained on the outside of the screen 720 by virtue of the proper sizing of the apparatus thereof. The gravel-free carrier fluid then enters tail pipe bore 832, and returns past ball check valve 800 which is unseated by fluid passing in an upward direction. The fluid then proceeds through axial circulation passage 762 in isolation gravel packer 760, then up through inner blank pipe 750 to the surface. Circulation of the gravel slurry is continued to build up a gravel pack from below gravel screen 720 to a point above it, thus interposing a barrier to sand migration from the zone into the liner 34. When pressure resistance is noted at the surface, this indicates that gravel in the lower zone has been deposited (packed) higher than the top of gravel screen 720, and the pack has been completed.

If desired at this point, the gravel pack may be further consolidated by applying pressure to it, referred to as squeezing. To effect this, pressure is applied down the blank pipe annulus 751 after closing off blank pipe 750 at the surface. This pressure will act upon the pack through the same circulation path as described previously. Fluid is contained below isolation gravel packer 760 by downward-facing packer cup 784, as during normal circulation. In order to clear the interior of the tool string 60 of residue, circulation is then reversed using a clean fluid. No movement in the well bore is required to effect this operation, the only action on the part of the operator being necessary is to reopen blank pipe 750 if a squeeze has been applied to the pack. Clean fluid is sent down blank pipe 750 to axial circulation passage 762 in isolation gravel packer 760. When the fluid reaches check valve 800, ball 806 is seated on valve seat 804 preventing flow downward. At this point, the clean fluid will then exit isolation gravel packer 760 through lateral circulation passages 786 and 788, and flow upward, past collapsing packer cups 778 and 780, and back through gravel passages 772 and 774 into inner annular passage 776, through outer passages 764 and 766 to blank pipe annulus 751. When clean fluid is returned to the surface, the packing job is complete.

At this point, the tool string 60 may be moved upward to the higher zone of interest between casing inflation packers 610 and 670. The tool string 60 is reciprocated upward, thus retracting the anchor positioner 30 and disengaging anchor tool 32'. As the tool string 60 is pulled up to the next zone, the passing spring arms 822 and 824 of closing sleeve positioner 820 pulls sleeve 684 of gravel collar 680 upward, the upward facing outwardly radially extending shoulders of the protrusions on spring arms 822 and 824 engaging downward facing annular shoulder 690 in sleeve 684. As gravel collar 680 is closed, the upper shoulders on spring arms 822 and 824 encounter the necked-down area above sleeve 684, which compresses spring arms 822 and 824, releasing them from shoulder 690 of sleeve 684. The tool string 60 continues up to the next zone, where it is reciprocated downward briefly, and then upward again to release anchor positioner 30, it being subsequently lowered downward into anchor tool 32. If the casing inflation packer 610 above the upper zone has been previously inflated, this final upward reciprocation can effect the opening of gravel collar 620, by engaging sleeve 624 with the spring arms of opening sleeve positioner 810.

When the anchor positioner 30 has engaged anchor 32, gravel packing may proceed at this zone, after inflating the packer 610 above it if that operation has not been done previously. After packing of the upper zone of interest is effected, the operating string 30 is withdrawn and the well may be produced.

DESCRIPTION AND OPERATION OF A FIRST ALTERNATIVE EMBODIMENT

Referring now to FIGS. 7A, 7B, 8 and 9, the construction and operation of a first alternative embodiment of the present invention will be described.

As stated previously, liner 34 is disposed within casing 36 in the well bore. Anchor tool 32, the same anchor tool utilized with anchor positioner 30, is once again employed.

Figure 9:
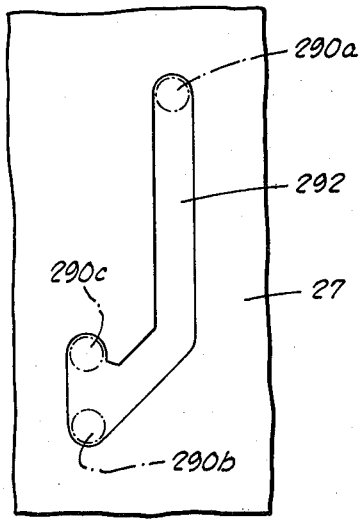
FIG. 9 is a development of the J-slot employed with the embodiment of the present invention shown in FIGS. 7 and 8.

Anchor positioner 230 is lowered into liner 34 by tool string 60, and is theadably attached thereto by adapter 270, a fluid seal being achieved through the use of O-ring 274. Mandrel 272 has slidably disposed thereon drag block assembly 276. Fixed to drag block assembly 276 is pin 290, which slides in slot 292 in mandrel 272. A development of slot 292, which is a true "J" slot is illustrated in FIG. 9. Disposed about drag block assembly are a plurality of circumferentially spaced axial slots 296 with drag blocks 294 retained therein by brackets 298 and 300, anchored to drag block assembly by bolts 302 and 304. Drag blocks 294 are biased outwardly by springs 306. The right-hand side of drag block assembly 276 has been rotated 45° for convenience, to illustrate axial flat 310 which may be interposed between each drag block 294 from the top of the drag block assembly 276 to port 312 which communicate between axial flats 310 and frusto-conical surface 314 at the lower end of drag block assembly 276. Mandrel 272, like mandrel 72, may have bore 264 therein to communicate with bore 62 of tool string 60, and bores 266 and 68 below mandrel 272.

Below drag block assembly 276 is disposed spring arm collar 116 with spring arms 118 and 120, as previously described. Spring arms 118 and 120 possess shoulders 130 and 132, each having a flat outer edge interposed between beveled leading and trailing edges. Above shoulders 130 and 132 are located protrusions 134 and 136, with radial or perpendicular downward-facing shoulders 138 and 140, above which are axial flats and inwardly inclined outer edges extending to tips 126 and 128. Spring arm collar 116 is fixed to mandrel 272 by threaded engagement of lower body 322 with mandrel 272, a fluid seal being effected by O-ring 324. The remainder of the tool string below anchor positioner 230 is again designated generally by the numeral 142.

Figure 8:
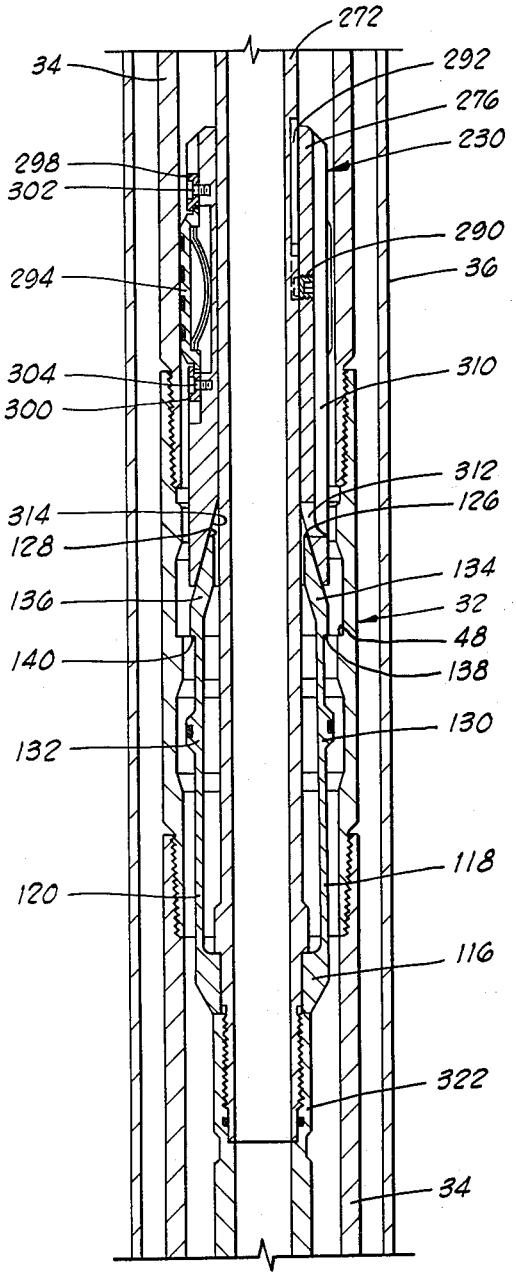
FIG. 8 provides a vertical cross-sectional elevation illustrating the anchor positioner of FIG. 7 in its retract mode after release from the anchor tool.

Alternative anchor positioner 230 is operated by rotation as well as reciprocation of tool string 60, and thus mandrel 272. When anchor positioner 230 is in its release mode, shown in FIGS. 7A and 7B, pin 290 is at the top of J-slot 292 in position 290*a*, as depicted in FIG. 9. When tool string 60 and mandrel 272 are pulled upwardly, pin 290 and drag block assembly 276 move relatively downward, and the lower, inclined edge of J-slot 292 guides pin 290 to position 290*b*, whereupon anchor positioner 270 is now in the retract mode as shown in FIG. 8, frusto-conical surface 314 having cammed the outer inclined edges of protrusions 134 and 136 inwardly. Subsequent downward movement of mandrel 272 moves pin 290 relatively upward to position 290*c*, thus locking the anchor positioner 230 into the retract mode. To release, upward movement of mandrel 272 followed by downward movement and rotation 30° to the right returns drag block assembly 276 to the position shown in FIG. 7A and the anchor positioner to the release mode. As with anchor positioner 30, drag block assembly 276 is held away from spring arms 118 and 120 in its release mode by frictional engagement of drag block 294 with the inner wall of liner 34.

Thus, in operation, the anchor positioner is lowered into the liner 34 along with other tools which cooperate with those in liner 34 at the appropriate levels, until the first anchor tool, for example, 32 is encountered. Spring arms 118 and 120 in the release mode will engage with shoulder 48, and the tool string will be anchored in place. Should one desire to descend to a lower anchor tool first, upward reciprocation of the tool string 60 will automatically retract the anchor positioner, and subsequent lowering of the tool string 60 will lock anchor positioner 230 in its retract mode. At the approximate location of the desired lower level, upward movement followed by rotating 30° to the right while lowering tool string 60 will again release spring arms 118 and 120 to lock onto the annular shoulder of the lower anchor tool. Notably, as with anchor positioner 30, spring arms 118 and 120 are configured so as to prevent hang-up in the event that drag block assembly should jam upward, permitting withdrawal of the tool string 60 from the well bore, and flats 310 in conjunction with radial ports 312 facilitate fluid movement past drag block assembly 276.

Figure 18A:
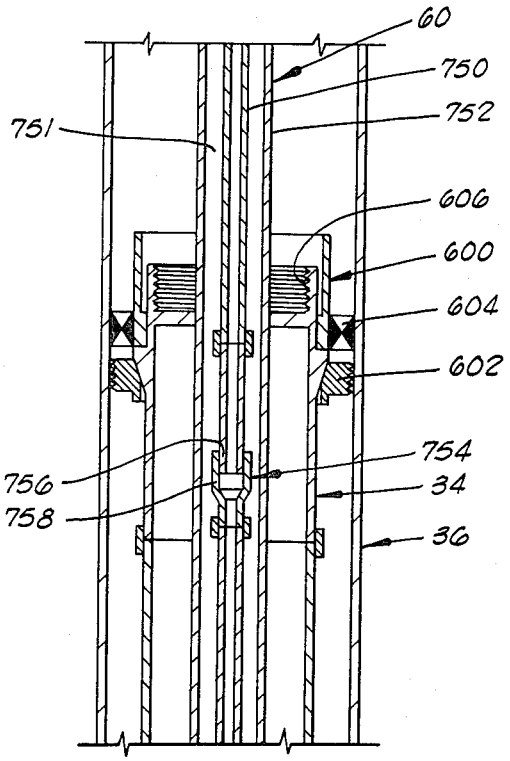
Figure 18B:
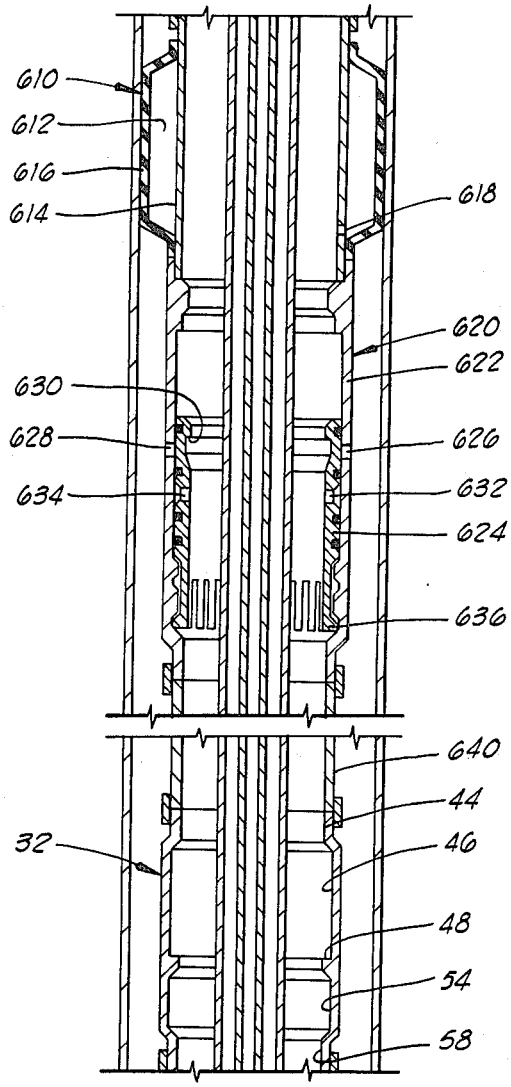
Figure 18:
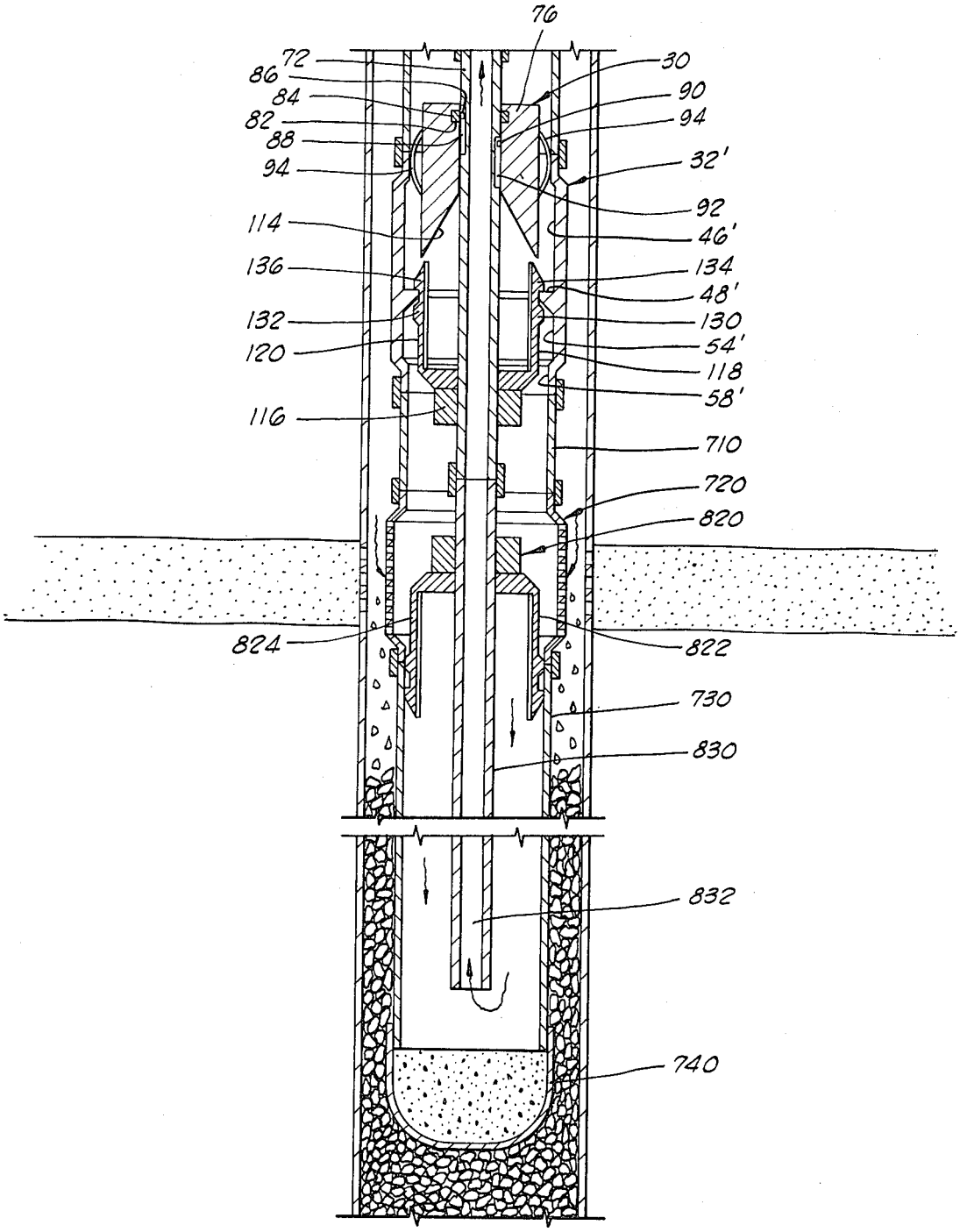
Figure 18:
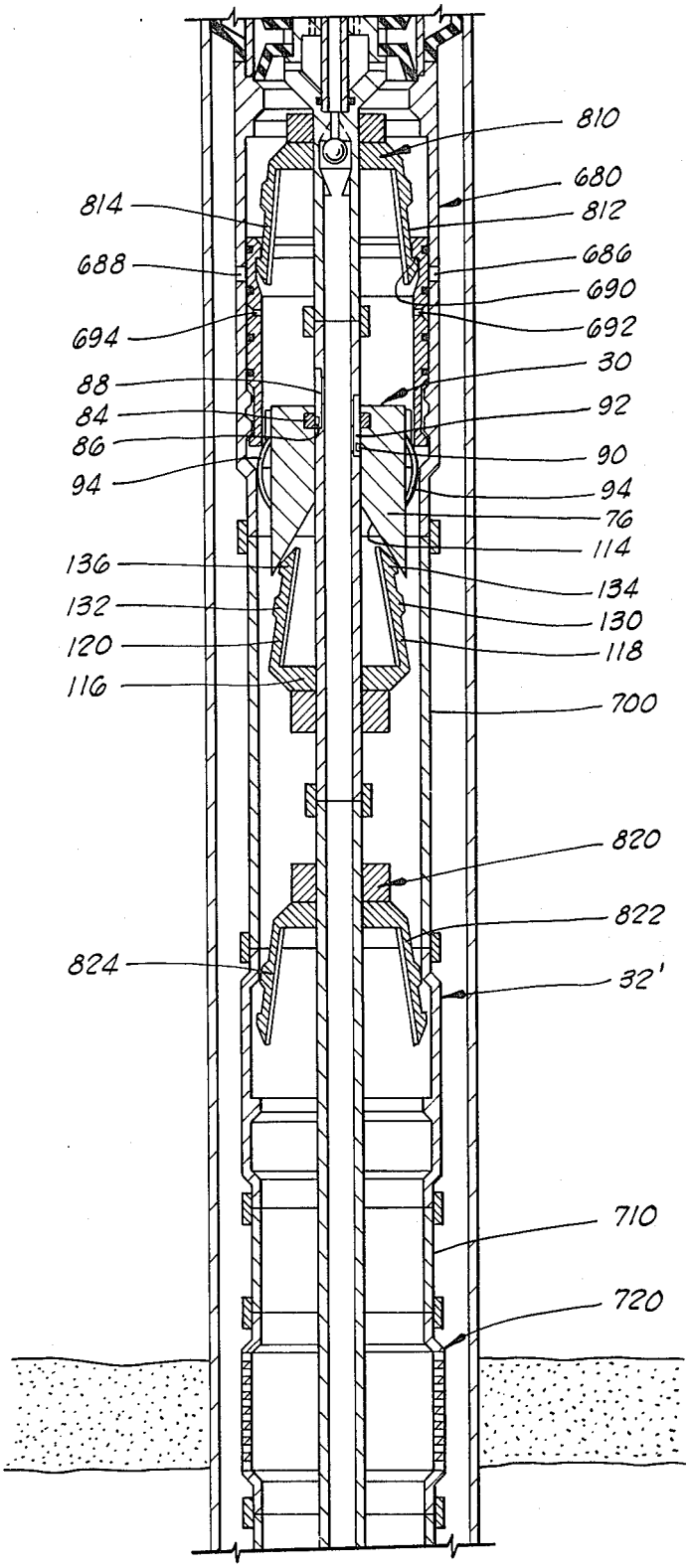

Anchor positioner 230 may be employed in lieu of anchor positioner 30 in FIG. 18 and FIG. 19, the only difference in manner of operation being, of course, the rotation as well as reciprocation of the tool string.

As with anchor positioner 30, it is obvious to one skilled in the art that certain modifications may be made to anchor positioner 230, such as placing pin 290 on mandrel 272, and the slot 292 on the inner surface of drag block assembly 276.

DESCRIPTION AND OPERATION OF A SECOND ALTERNATIVE EMBODIMENT

Referring now to FIGS. 10 through 17, a second alternative embodiment of the anchor positioner of the present invention will be described.

Anchor positioner 430 is disposed in a liner 34 inside casing 36 (for the purposes of illustration only it being noted previously that the present invention may be employed in a cased, unlined well bore) from tool string 60. Liner 34 has attached thereto anchor 432, comprising body 434 having upper bore 438 of substantially the same inner diameter as that of liner 34. As noted at 436, axially oriented splines are disposed around the interior of upper bore 438, at 60° intervals for the sake of illustration. Below slots 436 bore 438 widens to intermediate bore 442, the transition being made by beveled surface 440. Upon the surface of bore 442 are disposed anchor lugs 444, also, for the purposes of illustration, disposed at 60° intervals. Between each anchor lug 444, which have a beveled upper edge, axially flat medial edge and radially inward extending lower edge, are disposed channels 446 (shown in FIGS. 15 and 17). Below protrusions 444 intermediate bore 442 continues to the location of anchor lugs 448, having radial shoulders at their upper edges, axially flat medial edges and beveled lower edges. Anchor lugs 448 are also disposed every 60°, and are axially oriented with anchor lugs 444 around the circumference of intermediate bore 442. Between anchor lugs 448 are located channels 450, substantially identical to channels 446. Below anchor lugs 448, intermediate bore 442 narrows to lower bore 454, beveled edge 452 making the transition therebetween. Axially oriented splines 456 are disposed around the interior of lower bore 454, which is of substantially the same interior diameter as liner 34. Splines 436 and splines 456 are spaced 60° apart around the interior of the anchor tool 432; however, while splines 456 are axially aligned with anchor lugs 444 and 448, splines 436 are 30° out of phase, thereby being aligned with channels 446 and 450.

Anchor positioner 430, depending from tool string 60 possesses, if desired, an axial passage therethrough to permit passage of fluids from the tool string 60 to the well bore below anchor positioner 430. Anchor positioner 430 is attached to tool string 60 by adapter 460, a fluid-tight seal being effected between mandrel 464 and adapter 460 by seal 462. On the exterior of mandrel 464 is disposed drag block assembly 468, which is prevented from rotating about mandrel 464 by splined engagement with recess 466, shown in broken lines. Below drag block assembly 468, spring arm collar 484 is disposed around mandrel 464, being prevented from rotating about mandrel 464 by splined engagement with recess 486, shown in broken lines. Drag block body 468 and spring arm collar 484 are locked onto mandrel 464 by the threaded engagement of adapter 460 therewith. Drag block assembly carries drag block 470 in equidistantly spaced slots 472 60° apart on its exterior. Each drag block 470 is biased outwardly by a spring 482, and is held within its slot by brackets 474 and 476, which are attached to drag block assembly 468 by bolts 478 and 480. Depending downwardly from spring arm collar 484 are spring arms 488, also spaced 60° apart. Each spring arm 488 has thereon outward-facing shoulder 49, defined by an upper and a lower beveled edge. At the lowermost extremity of spring arm 488 is located protrusion 490, having radially extending upward-facing shoulder 494 thereon, followed by an axial flat and inwardly inclined outer edge 496 leading to tip 498. Below spring arm collar 484 on mandrel 464, spring arm collar 500 possesses upward-facing spring arms thereon designated at 504, spaced 60° apart. These spring arms are identical to spring arms 488, having outward-facing shoulders 506 thereon, protrusions 508 with downward-facing radially extending shoulders 510, above which are axially flat edges, and inwardly inclined outer edges extending upward to tip 514. Both sets of spring arms, as with those of the previously disclosed embodiment, are outwardly biased. Abutting and below spring arm collar 500 is drag block assembly 516, carrying thereon drag blocks 520 in slots 522 spaced 60° apart. The drag blocks 520 are each biased outwardly by a spring 532, and retained in their slots by brackets 524 and 526 held by bolts 528 and 530. Rotation of spring arm collar 500 with respect to mandrel 464 is prevented by splined engagement with recess 502, and rotation of drag block assembly 516 is prevented by splined engagement with recess 518, both recesses in mandrel 464. Drag block assembly 516 and spring arm collar 500 are held onto mandrel 464 by the threaded engagement of adapter 534 with mandrel 464, a fluid seal created therebetween by O-ring 536. The remainder of tool string 60, designated generally as 142, depends from adapter 534. Spring arms 488 and 504, as well as drag blocks 470 and 520 are all circumferentially aligned around the same points on the exterior of the mandrel.

Figure 10A:
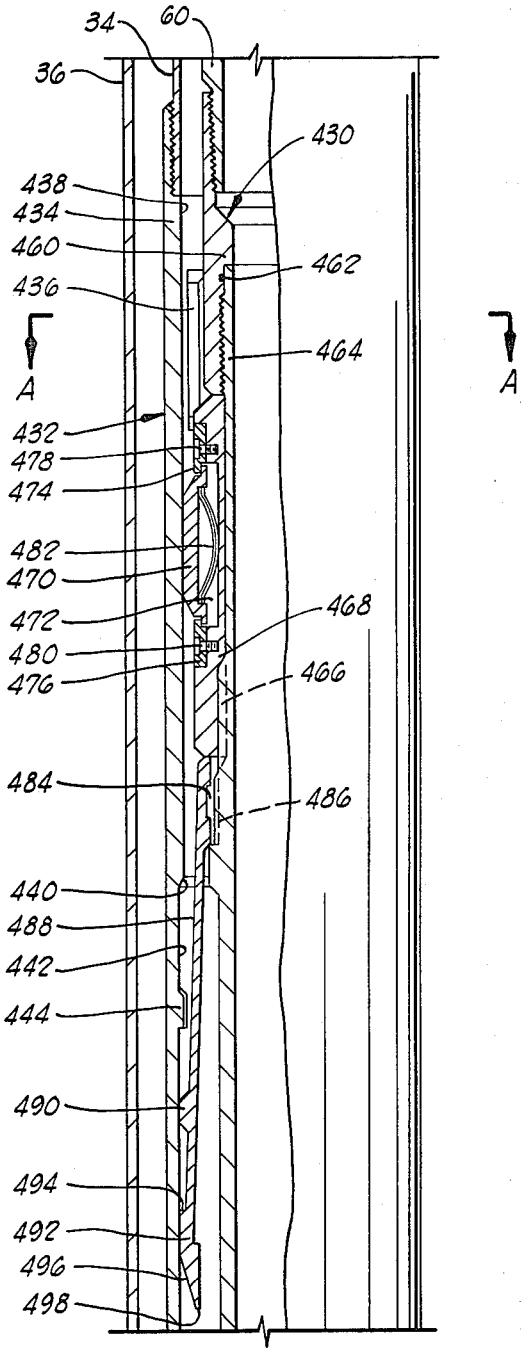
FIGS. 10A and 10B illustrate a vertical cross-sectional elevation of a second alternative embodiment of the anchor positioner and anchor tool of the present invention, the anchor positioner being anchored in the anchor tool.
Figure 10B:
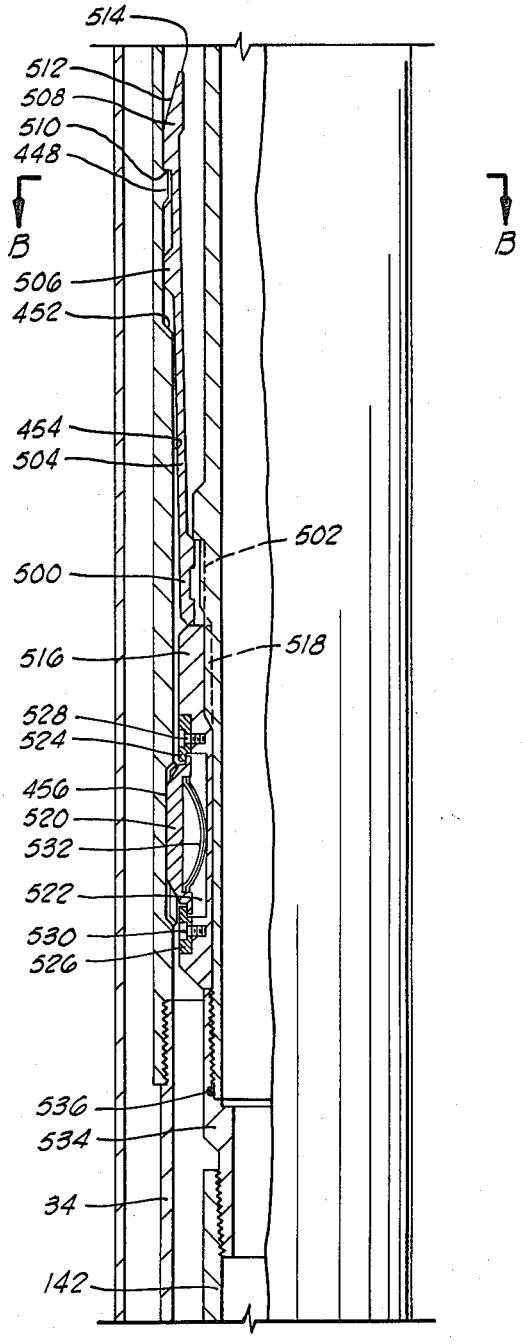
Figure 13:
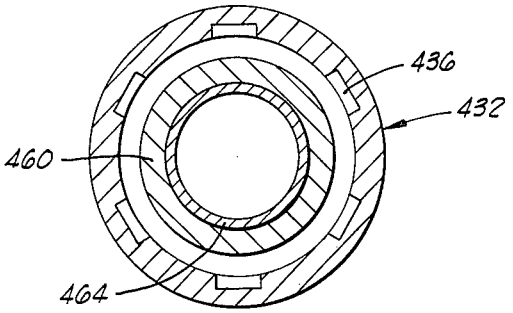
FIG. 13 is a horizontal cross-sectional elevation taken across line a—a of FIG. 10A.
Figure 14:
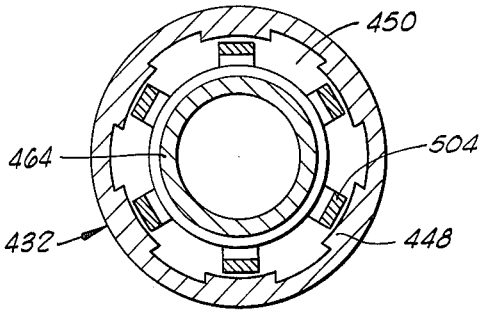
FIG. 14 is a horizontal cross-sectional elevation taken across line b—b of FIG. 10B.

In operation, the second alternative embodiment is disposed in liner 34, depending from tool string 60. Upon reaching anchor 432, lower spring arms 504 will engage protrusions 448, and the operator will note the tool string 60 beginning to take weight. At this point, the tool string is rotated to the right a maximum of 30°, whereupon, due to the spacing of shoulders 510 from drag blocks 520 and anchor lugs 448 from splines 456, drag blocks 520 drop into splines 456, thus locking the anchor positioner 430 into place. This orientation is shown in FIGS. 10A and 10B. FIG. 13, a horizontal section across line a—a of FIG. 10A, shows splines 436; FIG. 14, a horizontal section across line b—b of FIG. 10B, shows the alignment of lower spring arms 504 with anchor lugs 448.

Figure 11A:
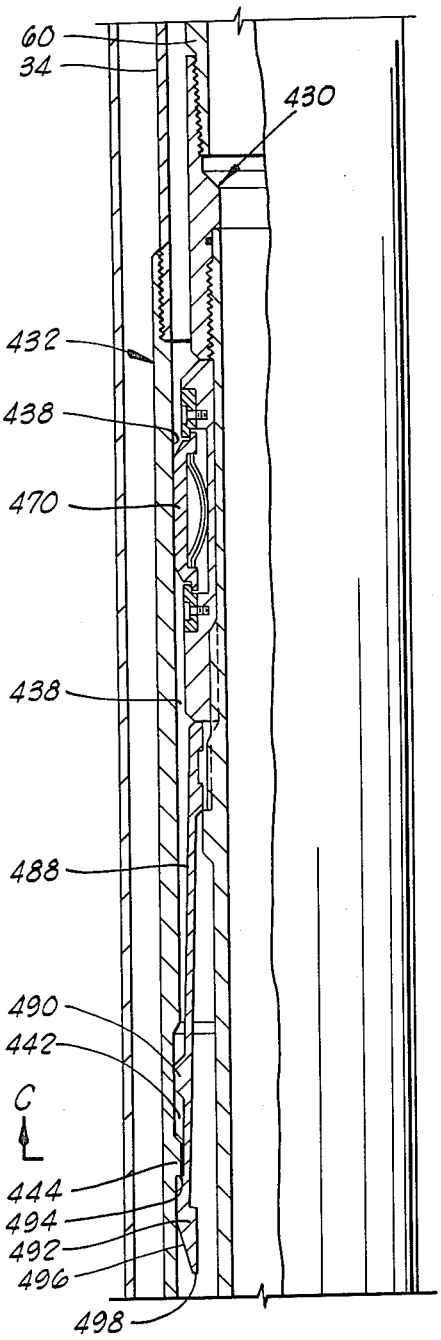
FIGS. 11A and 11B illustrate a vertical cross-sectional elevation of the second alternative embodiment of the present invention, the anchor positioner being disposed in an intermediate position as it is being released from the anchor tool.
Figure 11B:
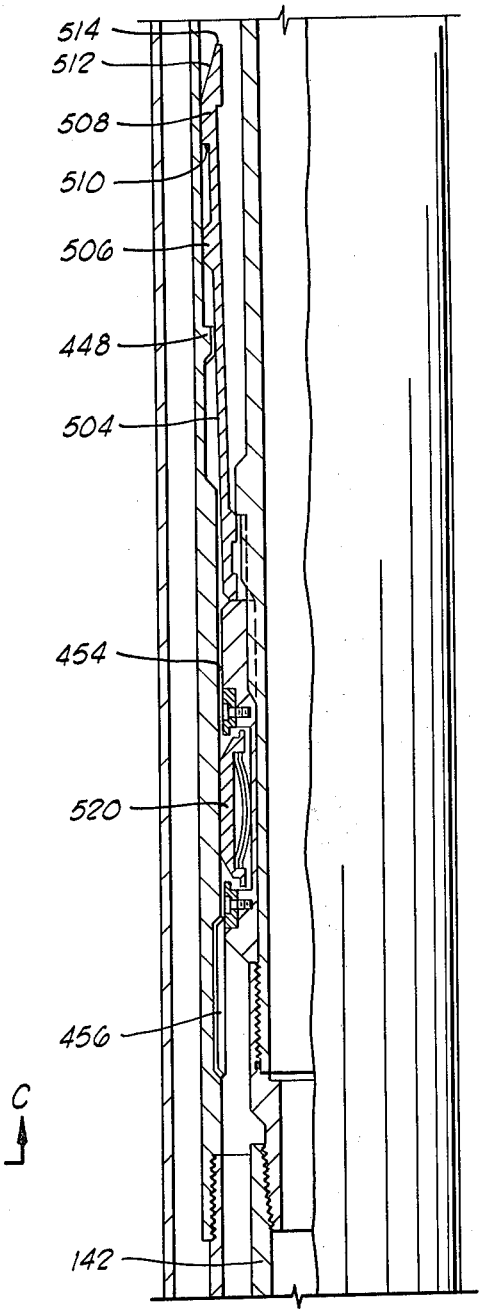
Figure 12A:
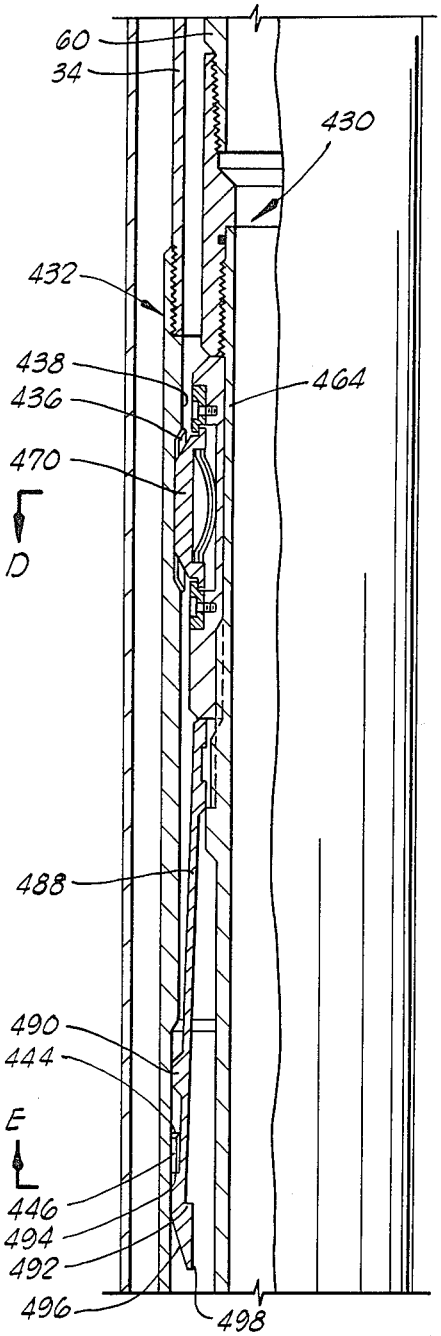
FIGS. 12A and 12B illustrate a vertical cross-sectional elevation of the second alternative embodiment of the present invention, the anchor positioner in position to be released from the anchor tool.
Figure 12B:
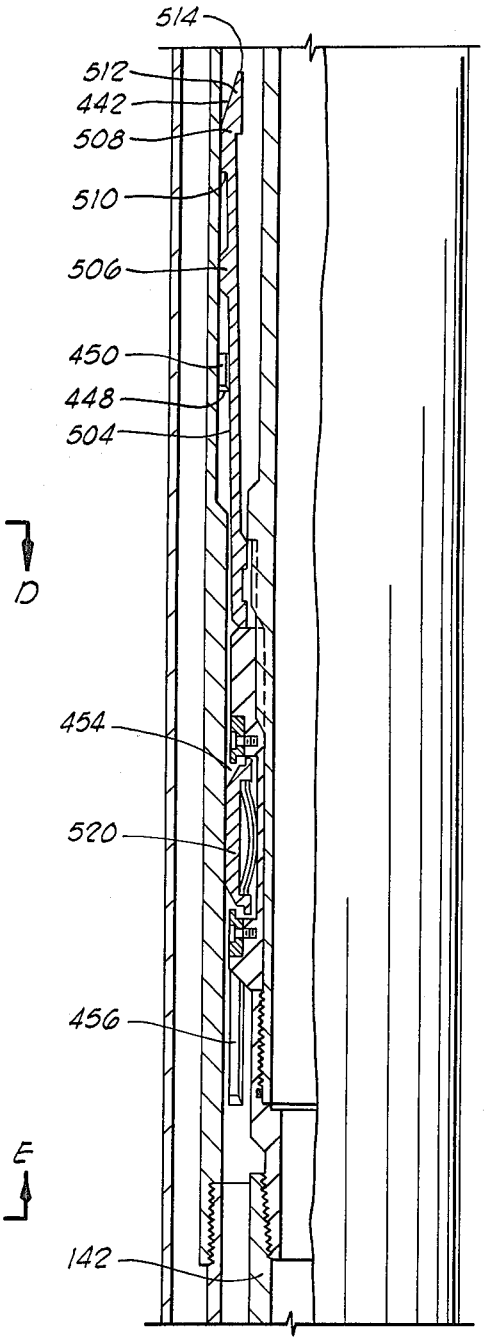
Figure 15:
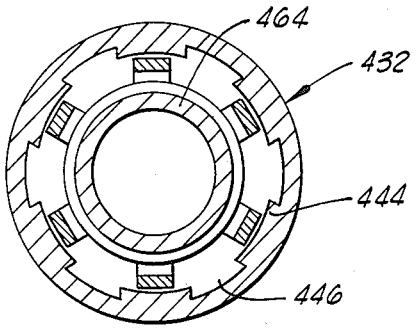
FIG. 15 is a horizontal cross-sectional elevation taken across line c—c of FIG. 11A.
Figure 16:
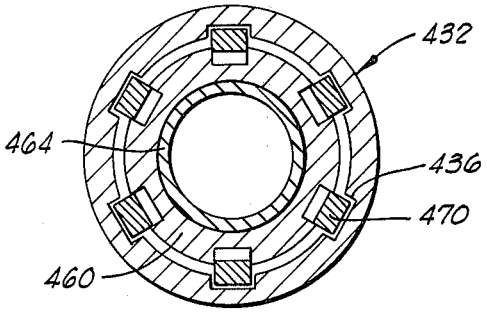
FIG. 16 is a horizontal cross-sectional elevation taken across line d—d of FIG. 12A.
Figure 17:
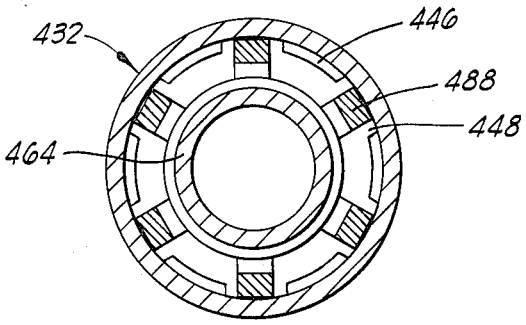
FIG. 17 is a horizontal cross-sectional view taken across line e—e of FIG. 12A.
Figure 16C:
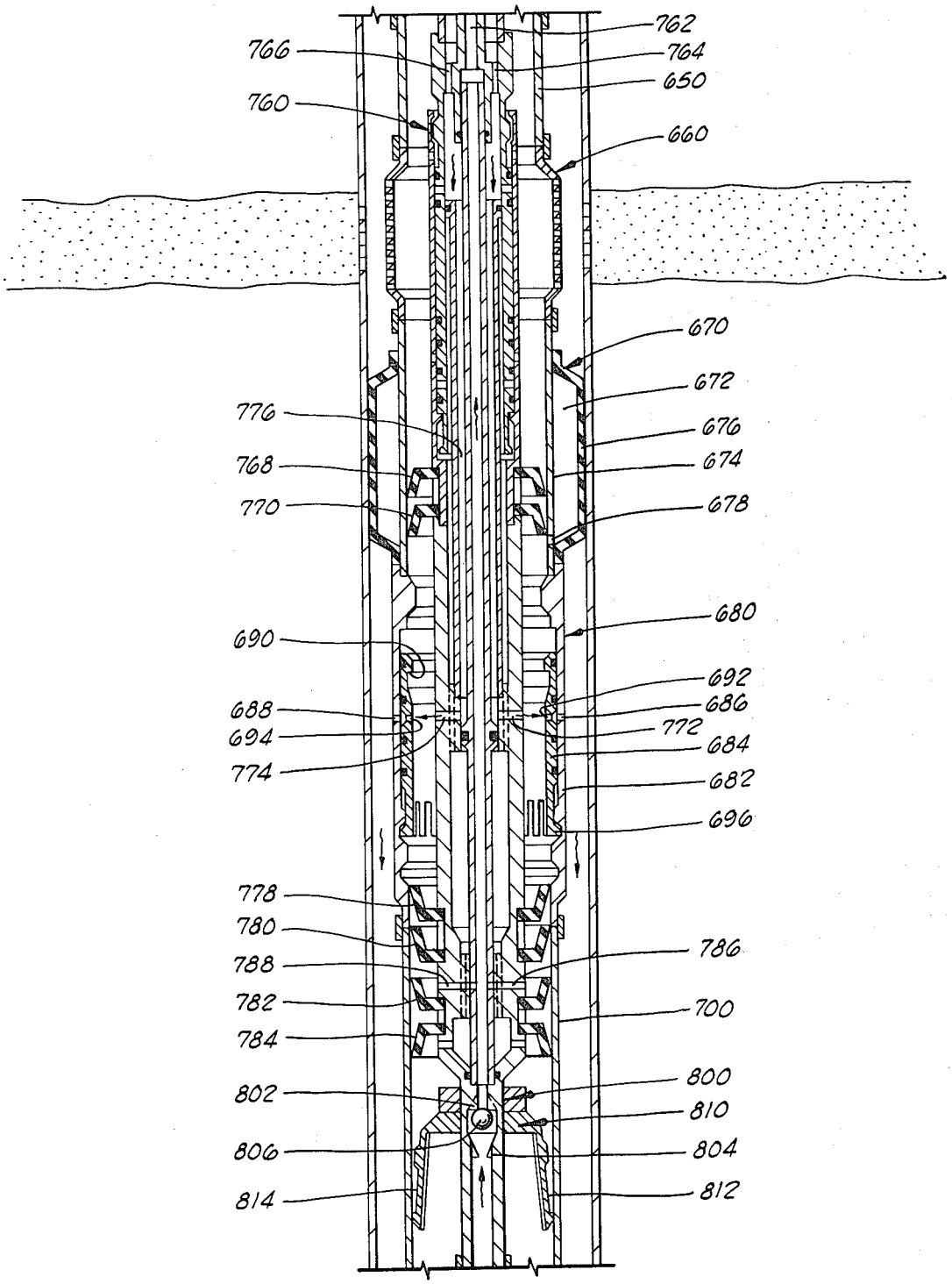

To release the anchor positioner 430 and tool string 60 after the desired operations have been performed at the level where anchor 432 has been located, tool string 60 is then picked up until shoulders 494 on upper spring arms 488 contact anchor lugs 444. This intermediate position is depicted in FIGS. 11A and 11B. FIG. 15, a section across line c—c on FIG. 11A, shows the alignment of spring arms 488 with anchor lugs 444. It is noted that drag blocks 520 have disengaged from and are now above splines 456, and that drag blocks 470, while axially aligned with splines 430, are 30° out of phase therewith, still resting against the interior wall of upper bore 438. Tool string 60 is now rotated again 30° to the right, whereupon drag blocks 470 drop into splines 436, and the anchor positioner 430 is again locked with respect to anchor tool 432. FIG. 16, a section taken across line d—d of FIG. 12A, shows drag blocks 470 in splines 436. It is noted that the casing bore has not been rotated, as it is in FIG. 12A. However, in this position all of the spring arms are aligned with the channels 446 and 450 between the anchor lugs 444 and 448 as are drag blocks 470 and 520. FIG. 17, a section through FIG. 12A at line e—e, shows the alignment of spring arms 488 with channels 446. This position is illustrated in FIGS. 12A and 12B, in which the anchor tool 432, rather than the tool string 60 and anchor positioner 430, has been rotated 30° for the sake of clarity. Thus, at this point, tool string 60 may be either raised or lowered through the anchor to a different level, without interference with the anchor lugs.

Movement of anchor positioner 430 through liner 34 is facilitated by shoulders 490 and 506, which bias the spring arms inwardly so the tendency to hang up is minimized. Upon reaching greater diameter of intermediate bore 442, however, the spring arms are permitted a greater radial extension, permitting engagement with anchor lugs 444 and 448. Shoulders 490 and 506 also facilitate movement of the spring arms over the locking lugs.

Of course, modification to the above disclosed apparatus will render themselves obvious to those of ordinary skill in the art, such as: changing the number of drag blocks, spring arms, protrusions and/or splines to vary the degree of rotation required for operation; utilizing a biasing means with the drag blocks other than the disclosed leaf springs; orienting the spring arms away from, in lieu of facing, each other; placing the drag blocks differently; utilizing only one set of drag blocks with two sets of splines; or making the spring arms into one complex spring.

Although the invention has been described in terms of certain embodiments which are set forth in detail, it should be understood as previously noted in several instances that descriptions herein are by way of illustration and not by way of limitation of the invention; as alternative embodiments of the apparatus and operating techniques of the method will be readily apparent to those of oridinary skill in the art in view of the disclosure.

In addition to those alternatives and modifications previously enumerated it would be obvious in the preferred and first alternative embodiments of the present invention to extend the length of the spring arms and the axial extent of the inclined face on the drag block assembly, so that the spring arms are never entirely released by the drag block assembly, but permitted to bias outwardly a sufficient radial extent to engage the shoulder of an anchor tool. Another possibility is to maintain the same axial dimension of the spring arms and drag block face, but radially outwardly extend the spring arm shoulders to give the desired contact with the anchor tool. It would also be obvious in the preferred and first alternative embodiments to employ less than four spring arms or more than four, depending on the size of the liner or casing, and to use a plurality of drag blocks to centralize the spring arms in the well bore if necessary. Further, in lieu of spring arms, spring-biased dogs having tapered edges facing the inclined face of the drag block assembly could be employed. Accordingly, modifications such as these and others are contemplated without departing from the spirit and scope of the claimed invention.

We claim:

1. Apparatus for positioning and anchoring a tool string in at least one location in a well bore having conduit means disposed therein, comprising:

anchor means having at least one shoulder means thereon fixed to said conduit means at said at least one location in said well bore;

anchor positioner means attached to said tool string, said anchor positioner means including engagement means comprising at least one spring arm selectively changeable between a release mode and a retract mode, said spring arm being adapted in said release mode to engage said anchor shoulder means when placed adjacent thereto, and to disengage said anchor shoulder means in said retract mode; and retraction means to effect said release and retract modes of said at least one spring arm of said engagement means, said retraction means having an inclined face thereon, and being axially slidable on said anchor positioner means responsive to movement of said tool string, said retraction means effecting said retract mode of said at least one spring arm by axial movement toward said at least one spring arm and radially inwardly biasing contact of said inclined face therewith, and effecting said release mode by axial movement away from said at least one spring arm and substantial release therefrom.

2. The apparatus of claim 1 wherein said at least one location is a plurality of locations, and said at least one anchor means being a plurality of anchor means fixed to said conduit at said plurality of locations.

3. The apparatus of claim 2 wherein said plurality of anchor means are substantially identical.

4. The apparatus of claim 3 wherein said movement is axial movement.

5. The apparatus of claim 1 further comprising:

shoulder means on said at least one spring arm, whereby said at least one spring arm means in said release mode engages said anchor shoulder means.

6. The apparatus of claim 5 wherein said anchor shoulder means extends radially inward from said conduit, said spring arm shoulder means extends radially outward from said spring arm, and the outermost edge of said spring arm shoulder means is located on a radius of greater extent than that defined by the innermost edge of said anchor shoulder means when said at least one spring arm is in said release mode, and said outermost edge of said spring arm shoulder means is located on a radius of lesser extent than that defined by said anchor shoulder means innermost edge when said at least one spring arm is in said retract mode.

7. The apparatus of claim 6 wherein said at least one spring arm is a plurality of spring arms.

8. The apparatus of claim 1 wherein the portion of said anchor positioner means to which said tool string is fixed and whereon said retraction means is mounted comprises mandrel means having slot means on the surface thereof, said slot means having axial and circumferential components and having at least one recess therein and said retraction means has attached thereto pin means slidably confined within said slot means, whereby the axial movement of said retraction means with respect to said at least one spring arm is directed, and whereby when said pin means enters said at least one recess, said inwardly biasing contact of said inclined face with said at least one spring arm is selectively maintained.

9. The apparatus of claim 8 wherein said mandrel means is cylindrical; slot means comprises a J-slot, said J-slot having an axial component and a recess circumferentially offset therefrom; and said pin means comprises a pin fixed to said retraction means, said pin entering and leaving said recess in response to axial and rotational movement of said mandrel means.

10. The apparatus of claim 9 further comprising drag block means mounted on said retraction means, said drag block means frictionally slidably contacting the inside of said conduit means.

11. The apparatus of claim 1 wherein: at least a portion of said mandrel means is cylindrical; said slot means comprises first and second slots, said first slot having an axial component, and said second slot having axial and circumferential components and at least one recess therein;

said pin means comprises first and second pins, one end of said first pin being fixed to said retraction means and the other end being slidably confined in said first slot, said second pin being fixed to ring means axially and rotationally slidably disposed about said mandrel means and rotationally slidably confined in an annular recess in said retraction means, the free end of said second pin being disposed in said second slot, whereby, when said tool string is axially reciprocated, said first pin prevents rotational movement of said retraction means, and said second pin follows the path defined by said second slot to enter said recess, and upon subsequent axial reciprocation, said second pin leaves said recess.

12. The apparatus of claim 11 further comprising drag block means mounted on said retraction means, said drag block means frictionally slidably contacting the inside of said conduit means.

13. Apparatus for positioning and anchoring a tool string in at least one location in a well bore having conduit means disposed therein, comprising:

anchor means having two axially spaced shoulder means thereon fixed to and extending radially inward from said conduit means at said at least one location in said well bore, each of said shoulder means having at least one discontinuity therein, said discontinuities being circumferentially aligned; and anchor positioner means attached to said tool string, said anchor positioner means including engagement means comprising a plurality of spring arms, at least one of said plurality extending upward, and at least another of said plurality extending downward, said upward and downward extending arms being aligned and spaced so as to not axially overlap, whereby said spring arms will pass through said discontinuities when aligned therewith, and said at least one upward-facing spring arm will engage one of said shoulder means against substantially axially downward movement of said tool string when not aligned with said at least one discontinuty in said one of said shoulders, and said at least one downward facing spring arm will engage said other shoulder means against substantially axially upward movement of said tool string when not aligned with said at least one discontinuity in said other shoulder means.

14. The apparatus of claim 13 further comprising at least two axially spaced splines in said conduit means, the first of said at least two splines being circumferentially aligned with said discontinuities, the second of said at least two splines being misaligned therewith; drag block means on said anchor positioner means circumferentially aligned with said spring arm, whereby engagement of said drag block means in said first of said at least two splines holds said spring arms in circumferential misalignment with said discontinuities, and engagement of said drag block means with said second of said at least two splines holds said spring arms in circumferential alignment with said discontinuities.

15. The apparatus of claim 14 wherein said at least two splines are axially spaced to permit axial movement a sufficient distance to permit axial disengagement of said drag block means with the first of said at least two splines and engagement of said drag block means with the second of said at least two splines upon rotation of said tool string to move said drag block means into engagement therewith, whereby said spring arms may be aligned with said discontinuities and said anchor positioner may be released from said anchor means by axial movement of said tool string while said spring arms are in engageable relationship with said two shoulder means.

16. The apparatus of claim 15 wherein said at least two splines comprises a first plurality of splines circumferentially spaced from a second plurality of splines, said at least one discontinuity in each shoulder means comprises a plurality of discontinuities in each shoulder means, said first plurality of splines being aligned with said discontinuities, and said second plurality of splines being misaligned therewith; and said drag block means comprising at least two drag blocks, at least one of which is adjacent to said at least one upward-facing spring arm and at least another of which is adjacent to said at least one downward-facing spring arm.

17. The apparatus of claim 16 wherein said at least one upward-facing spring arm comprises a plurality of upward-facing spring arms, and said at least one downward-facing spring arm comprises a plurality of downward-facing spring arms.

18. The apparatus of claim 17 wherein said at least two drag blocks comprises a plurality of drag blocks each adjacent to an upward-facing spring arm and aligned therewith, and a second plurality of drag blocks each adjacent to a downward-facing spring arm and aligned therewith.

19. The apparatus of claim 18 wherein said spring arms, said drag blocks, said discontinuities and said splines are spaced at 60° intervals, said discontinuities in one of said shoulder means being 30° out of phase with said discontinuities in said other shoulder means.

20. The apparatus of claim 19 wherein said spring arms engage said shoulder means on said conduit means with outwardly radially extending shoulders proximate the extremities of said spring arms.

* * * * *

UNITED STATES PATENT AND TRADEMARK OFFICE

CERTIFICATE OF CORRECTION

PATENT NO. : 4,369,840

DATED : January 25, 1983

INVENTOR(S) : David D. Szarka and Eugene E. Baker

It is certified that error appears in the above-identified patent and that said Letters Patent is hereby corrected as shown below:

Column 5, line 30, change "spring" to --string--
Column 6, line 18, change "spring" to --string--
Column 6, line 45, change "The" to --To--
Column 6, line 46, change "spring" to --string--
Column 7, line 2, change "diameter" to --diameters--
Column 8, line 7, change "collect" to --collet--
Column 8, line 19, change the numeral "600" to --660--
Column 11, lines 48-49, change "apparatus" to --apertures--

Signed and Sealed this

*Twenty-first* Day of *June 1983*

[SEAL]

*Attest:*

DONALD J. QUIGG

*Attesting Officer*

*Acting Commissioner of Patents and Trademarks*